US005534061A

United States Patent [19]

Fitzburgh

[11] Patent Number: 5,534,061

[45] Date of Patent: Jul. 9, 1996

[54] APPARATUS FOR WAXING SNOWBOARDS, SKIS AND THE LIKE

[76] Inventor: Brian Fitzburgh, 2965 Waverly Dr. #2, Los Angeles, Calif. 90039

[21] Appl. No.: 502,802

[22] Filed: Jul. 14, 1995

Related U.S. Application Data

[63] Continuation-in-part of Ser. No. 307,298, Sep. 16, 1994, abandoned.

[51] Int. Cl.[6] ..... B05C 21/00

[52] U.S. Cl. ..... 118/59; 100/211; 100/93 P; 156/583.3; 118/76; 118/101; 118/202; 219/544; 219/549

[58] Field of Search ..... 118/699, 712, 118/59, 76, 101, 202; 100/211, 93 P; 156/583.1, 583.3; 219/544, 528, 549, 486

[56] References Cited

U.S. PATENT DOCUMENTS

| | | | |
|---|---|---|---|
| 3,549,461 | 12/1970 | Bennett | 156/583.3 |
| 3,711,678 | 1/1973 | Kuus | 118/101 |
| 3,904,850 | 9/1975 | Johnson | 219/538 |
| 4,108,713 | 8/1978 | Weisz | 156/583.3 |
| 4,308,633 | 1/1982 | Van Huffel et al. | 15/104.93 |
| 4,445,025 | 4/1984 | Metz | 219/528 |
| 4,468,557 | 8/1984 | Bylin et al. | 219/535 |
| 4,923,560 | 5/1990 | Inselmann | 100/93 |
| 4,987,291 | 1/1991 | McGaffigan et al. | 219/549 |
| 5,004,190 | 4/1991 | Montierth et al. | 246/248 |
| 5,012,758 | 5/1991 | Künzler | 118/72 |

*Primary Examiner*—Laura Edwards

*Attorney, Agent, or Firm*—Hopgood, Calimafde, Kalil & Judlowe

[57] ABSTRACT

For efficient waxing of the running surface of a workpiece such as a snowboard, one or more skis, or a toboggan, the invention provides a single wax-heating element in the form of an elongate flexible sheet sized to fully cover the running surface when upside down and horizontally oriented. The single sheet of the heating element also provides articulating connection between an array of like transverse elements which gravitationally load the heating element sheet into self-adapting conformance with flat or concave and convexly curved features of the workpiece, so that a wax-laden sheet draped over the running surface of the workpiece can be gravitationally loaded by the heating element sheet.

25 Claims, 5 Drawing Sheets

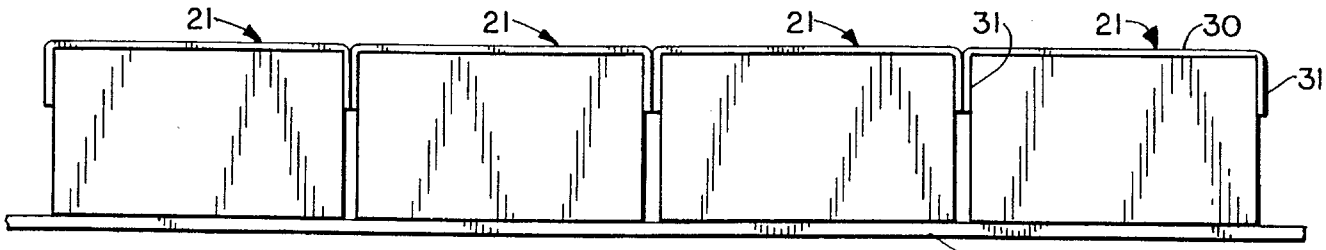
FIG.4
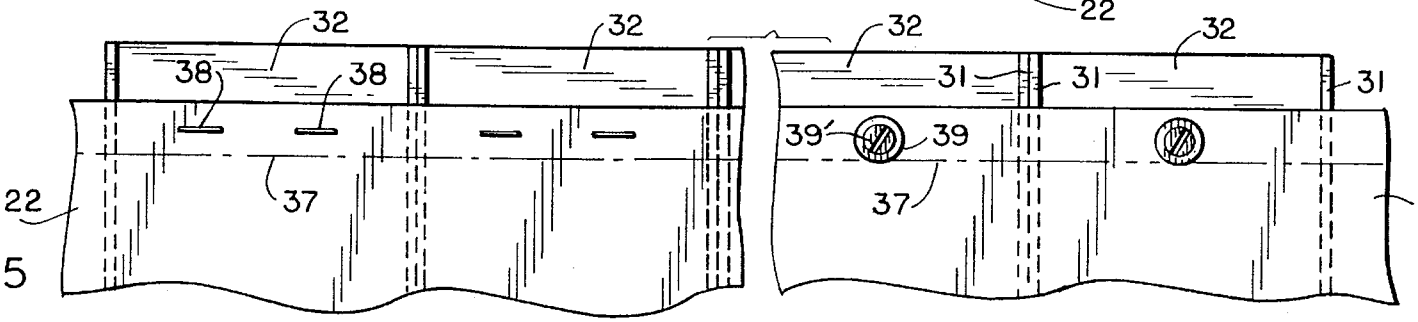
FIG.5A
FIG.5
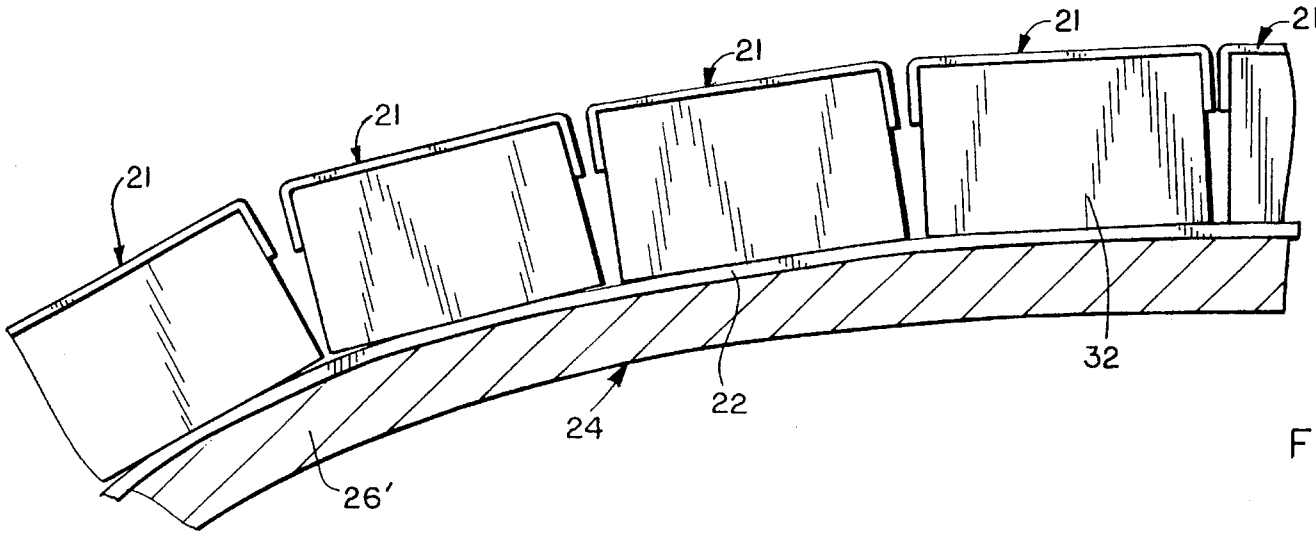
FIG.6

FIG. 8
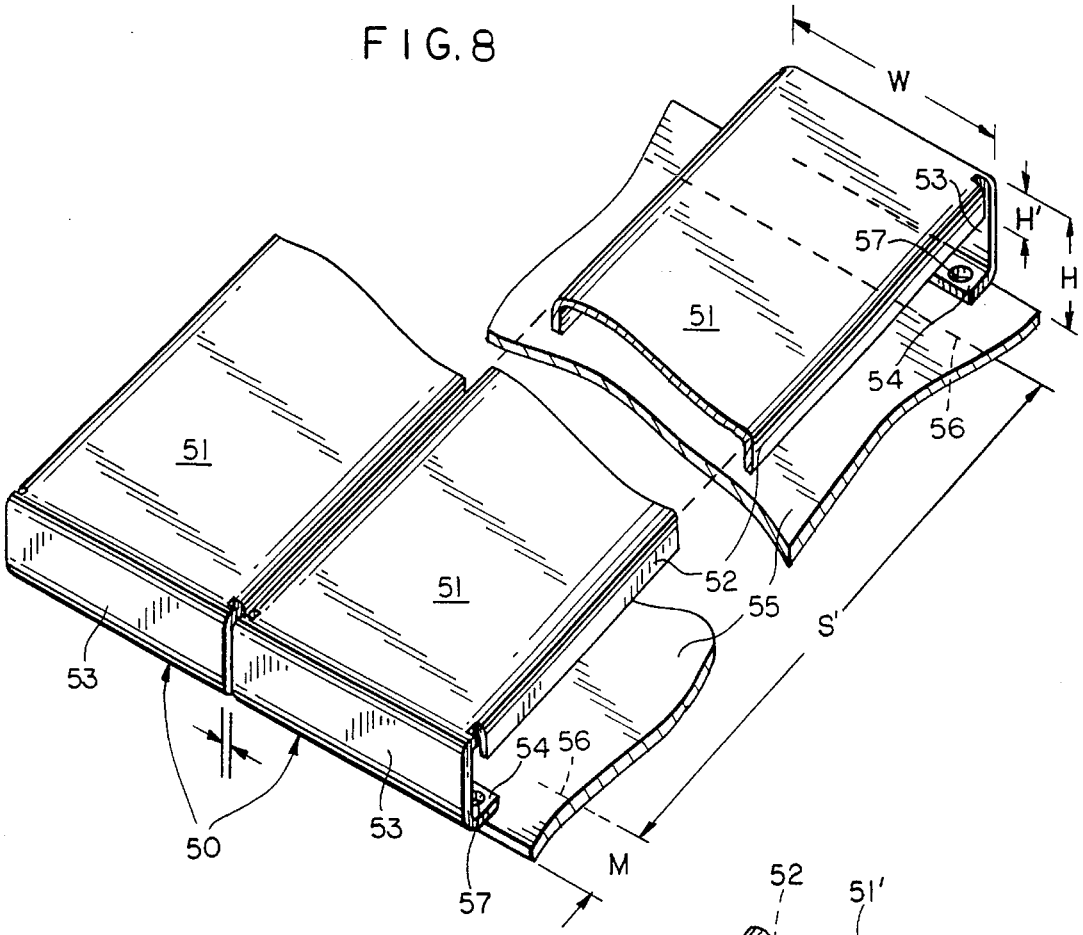
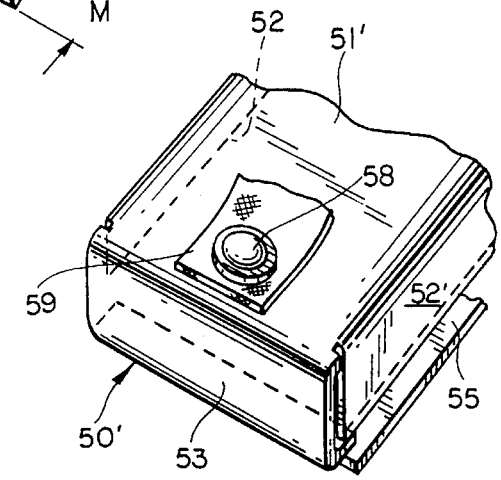
FIG. 8A

APPARATUS FOR WAXING SNOWBOARDS, SKIS AND THE LIKE

RELATED CASE

This application is a continuation-in-part of my application Ser. No. 08/307,298, filed Sep. 16, 1994, now abandoned.

BACKGROUND OF THE INVENTION

The invention relates to application of a wax to a surface and more particularly to an improved means and method of applying wax to snowboards, snow skis, toboggans or other articles of manufacture.

Some commonly used techniques, such as hand application for ski waxing, apply several times as much wax as is actually necessary. Excess wax is then, after being applied, scraped off and discarded. As a consequence, the removed wax presents possible shop hazards, a mess, and obviously a great waste of wax. Current methods which are effective are either laborious or involve expensive professional equipment. The problems with ski waxing are compounded for devices such as snowboards and toboggans, which have much greater areas to be serviced with wax.

U.S. Pat. No. 4,308,633 proposes to solve the problem of waste, by providing a multilayer wax-impregnated carrier element which may be heat-applied, as by a flat iron, to the running bottom surface of a ski, the carrier element being removed while the wax is still hot.

Further, a wax-impregnated sheet product, available under the mark SKINS from its source having the tradename SKINS, has been gaining acceptance, again wherein a flat iron provides the source of heat needed to assure penetration of molten wax into the running surface being treated. But there is much handwork and therefore time consumption, not to mention personal skill and technique, that is required for a professional and high-quality waxing operation. The SKINS product relies on a wax absorptive carrier such as a sheet of cloth or of a synthetic material which has been prepared with wax to essentially only the density (i.e., quantity of releasable wax, per unit area) that a ski bottom can be expected to absorb. The sheet is cut to length as appropriate, and a hot household flat iron is the recommended means of wax release to the point of saturating the ski bottom, thus leaving only a thin, uniform layer of wax on the ski bottom. This product and technique thus eliminate the need to scrape off any excess of applied wax, and the mess and waste of the past are avoided. But, as noted above, the work is largely by hand, and requires more time and skill than is desired.

BRIEF STATEMENT OF THE INVENTION

It is an object of the invention to provide an improved method and means of applying wax to skis and other articles of the character indicated.

It is a specific object to provide heating apparatus which is able to perform the necessary wax melting and penetration involved in wax treatment of an entire ski surface, snowboard surface or the like in a single operation.

Another specific object is to meet the above object with apparatus which will perform the full-surface treatment of an article of the character indicated, as a completely automatic operation, in a minimum of time and with enhanced assurance of a quality job.

A general object is to achieve the above objects with apparatus requiring a minimum of personal skill and at a substantial saving of cost, as compared with practices to date.

The invention achieves the foregoing objects by providing a fresh suitably wide, wax-laden carrier sheet which may be cut to the length of an article or workpiece to be waxed, the article being elongate and supported upside-down so that its running surface is generally horizontal and face-up. For skis, snowboards, toboggans and the like, the leading end is curved and in the indicated upside-down condition, the running surface to be waxed is generally flat except for the downward convex curve of its leading end, and, in some cases, except for an elongate concave region of camber, aft of the leading end. The wax-laden sheet is draped over the full extent of the running surface to be waxed, a flexible electric heating element is positioned over the wax-laden sheet, and a longitudinally flexible articulated series of like transverse members applies a uniformly distributed loading of the heating element and wax-laden sheet to the entire running surface. Control for the heating element involves presettable timing and monitored temperature distribution, to the end that wax impregnation in a single operation is optimized, for the particular running surface to be serviced; whereupon, the articulated structure and heating element are lifted enough to clear the carrier substrate from which wax was transferred to the running surface of the workpiece. A squeegee that is manipulated over any remnant molten wax (following substrate removal) will produce a beautifully smooth running surface finish to the serviced workpiece.

BRIEF DESCRIPTION OF THE DRAWINGS

A preferred embodiment of the invention will be described in detail in conjunction with the accompanying drawings, in which:

FIG. 4 is an enlarged fragmentary side elevation of articulated adjacent elements of FIG. 2, in horizontal array and at the horizontal upper limit of their range of articulation;

FIG. 5 is a plan view of the elements of FIG. 4 and their relation to a fragment of the associated heating element;

FIG. 5A is a view similar to FIG. 5 to show a modification;

FIG. 6 is a view similar to FIG. 4, to show articulated adjacent elements of FIG. 2 in self-adapted conformance to an upwardly facing convexly curved workpiece surface;

FIG. 8 is a view similar to FIG. 2 to show a modification;

FIG. 8A is a fragmentary view, similar to FIG. 8 but specifically for a corner portion of apparatus of FIG. 1;

DETAILED DESCRIPTION

Figure 1:
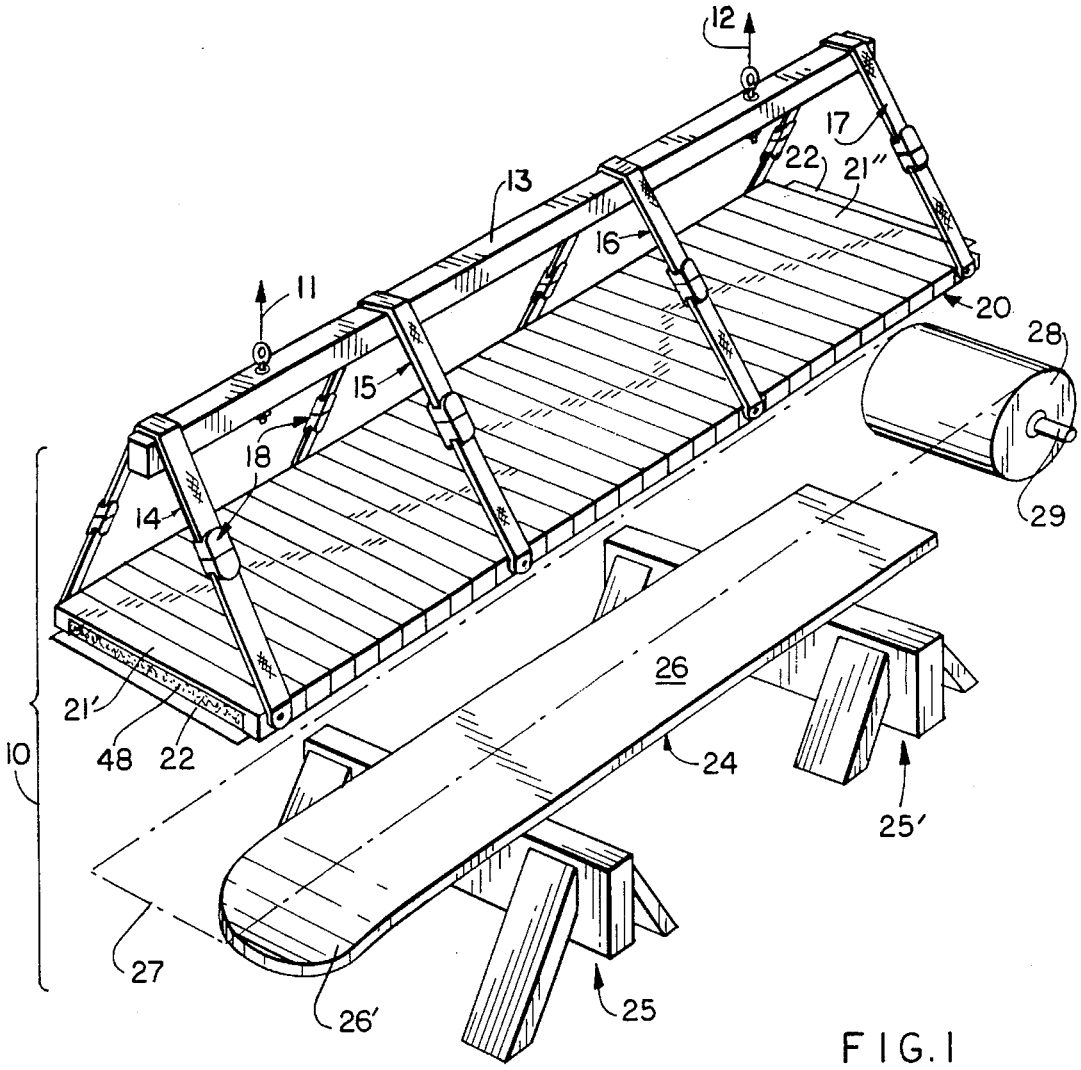
FIG. 1 is a simplified perspective view of waxing apparatus of the invention.

A general arrangement of separate components of the invention is presented in FIG. 1, and frame members which connect and support these components have been omitted for clarity of exposition, the overall connected interrelation of these components being merely suggested by all-embracing vertical bracketing 10, at the left margin of FIG. 1. Such frame members, or the crossbeam or joist of a room, will be understood to provide solid overhead referencing for one or more pulleys of a hoist system (suggested by suspension cables 11, 12) connected at spaced locations to an elongate horizontal suspension bar 13, by which four longitudinally spaced pairs of flexible straps (14, 15, 16, 17) in turn provide longitudinally distributed suspension of a heating element assembly which is generally designated 20.

As will later become clear, the heating element assembly 20 is an articulated succession of substantially identical transverse members 21 which, in the suspended condition of FIG. 1, are in their uppermost and most flattened condition of flexible articulation. Each of the straps (14, 15, 16, 17) is connected exclusively to the opposite ends of a single one of the transverse members 21, it being preferred that end straps 14, 17 be connected to transverse members 21' and 21" at the respective ends of the succession and that the remaining two straps (15, 16) be connected to intermediate transverse members so as to establish substantially uniform spacing between strap-connected transverse members. For convenience of packaging, inspection and maintenance, each suspension leg of each strap is shown with readily detachable engagement means 18. The heating element assembly carries a flexible electric heating panel or sheet 22 which in FIG. 1 is shown in the elevated position of assembly 20, above and in total longitudinal and transverse overlap of a workpiece 24.

Workpiece 24, which may be a snowboard, is shown supported upside-down, by and between longitudinally spaced saw horses 25, 25', thus upwardly presenting its bottom or running surface 26 for waxing treatment. It is noted that a snowboard may have symmetrically curved opposite ends, as for acrobatic or stunt uses of the snowboard, in which case the running surface 26 will have upwardly facing convexly curved ends; however, in many usages, and for present purposes, it is sufficient to show one such convex curvature at 26', namely, at the forward or leading contour of the workpiece.

Wax-impregnated or wax-coated substrate sheet material 27 is shown to be dispensable from a roll 28 that is mounted for rotation on a fixed horizontal axis, as provided by a shaft portion 29 of overall frame structure of the waxing apparatus. A length 27 of the wax-laden sheet is shown in FIG. 1 by phantom outline and will be understood to be cut to length, as appropriate, upon payout from roll 28 and draping over the entire running surface of workpiece 26.

The above-indicated SKINS sheet material is commercially available in different-length rolls, of width sufficient for present-day snowboards; the largest of these is 1350-feet long, good for 250 snowboard-waxing jobs. If the "workpiece" is a pair of skis, the snowboard-width material is more than adequate to wax both skis of the same pair in a single operation. Alternatively, narrower SKINS sheet material of suitable width for wax application to individual skis is also available and will be understood to be dispensable from two adjacent supply rolls (not shown) on the same dispensing mount or shaft 29. Preferably, shaft 29 is cantilevered from a single frame-mounted end, thus allowing quick loading of rolls 28 for particular use, as appropriate.

When the wax-laden sheet 27 has been cut-off from roll 28 and draped to cover the entire running surface 26, the hoist mechanism (symbolized at 11, 12) is operated to lower the bar 13 and its suspended heating assembly 20, to the point of gravitationally loading the heating sheet 22 into essentially complete coverage of sheet 27, with conformance to both the flat and curved portions of the workpiece. This lowering should be to the extent of totally supporting the articulated structure on the snowboard, thus relieving bar 13 of any support function, and with all straps (14, 15, 16, 17) in slack condition.

Figure 2:
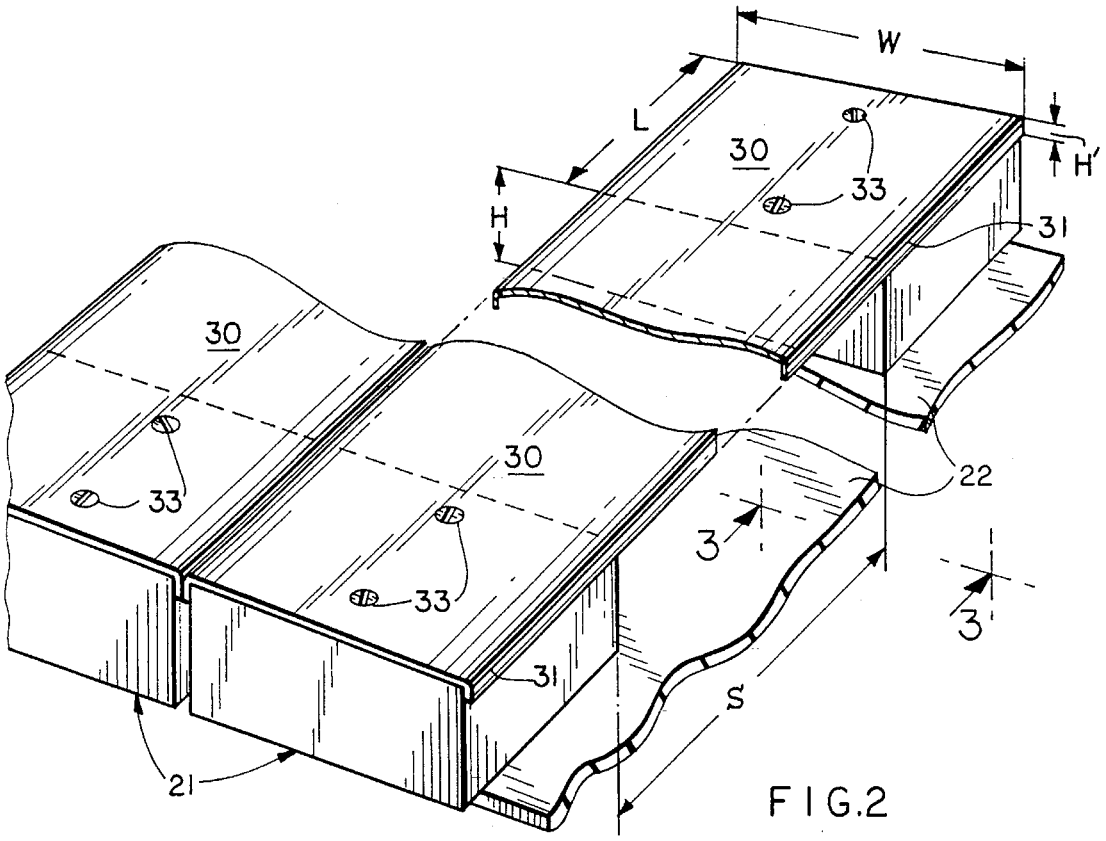
FIG. 2 is an enlarged fragmentary view in perspective to show detail of articulated adjacent elements in the apparatus of FIG. 1.

Directing attention now to FIGS. 2 to 6, the originally preferred construction of assembly 20 is seen to employ a longitudinal succession of like transversely oriented members 21 which are in abutting relation when assembly 20 is flat (FIGS. 2, 4 and 5). The overall cross-section of each element 21 is generally rectangular, wherein a flat upper surface is defined by the broad base 30 of an elongate metal channel member, suitably of formed 16-gauge aluminum sheet, with relatively short side walls 31 establishing a defined width W of each transverse member 21. Spacer blocks 32, suitably of hardwood such as oak or rock maple, are nested in the ends of the metal channel, with close back-up fit between and to the respective side walls 31 of the channel member. The end spacer blocks may be of length approximating the width dimension, and of thickness H substantially exceeding the height H' of the channel side walls 31, thus leaving a substantially greater transverse span S' between the end blocks 32 of each member 21. The spacer blocks 32 are shown secured to the ends of the channel by screws 33, and the generally rectangular section of each transverse member 21 is thus completed by the geometric plane established by the underside surfaces of the two spacer blocks 32 of each member 31.

Figure 3:
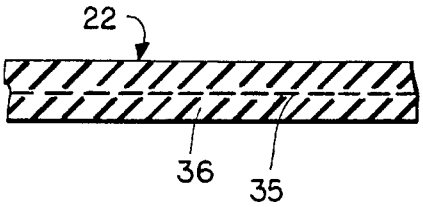
FIG. 3 is a further-enlarged sectional fragment of a heating element in the apparatus of FIG. 1, the section plane being generally designated 3—3 in FIG. 2.

The means of articulating interconnection of transverse members 21 is the flexible sheet 22 which is a composite containing electric heating means 35 (FIG. 3). For present purposes, it suffices to state preference that the electric resistance heating material of means 35 is a thin foil (an etched film) development which is embedded in an elastomeric body 36, suitably a silicone rubber containing glass fiber for resultant longitudinally flexible but essentially non-stretch properties in the sheet. The pattern of thin-film development, i.e., its effective "wiring" course over the area (or areas) of heat development can be generally as in electric blanket construction, except of course that the resistance "wires" are courses of flexible thin film. In the construction of sheet 22, it is important to note that the heating area of thin-film development is laterally short of the longitudinal edges of sheet 22, thus establishing an electrically inert margin (37, FIGS. 5, 5A) along each longitudinal edge of sheet 22. In FIG. 5, this marginal space is shown to enable staple fasteners 38 to be driven through sheet margins, for anchorage to the undersides of spacer blocks 32; in the alternative of FIG. 5A, a single wood screw 39, seated against a washer 39', suffices to retain sheet 22 to the transverse centerline of each end of each of the transverse members 21. Thus connected, whether in the manner of FIG. 5 or of FIG. 5A, successive members 21 firmly abut their channel sidewalls 31 in the flattened condition of FIG. 4; 4; and the flexible interconnection of their lower surfaces enables gravitational self-adaptation to a convex contour, as at 26', thus achieving the relationship of FIG. 6.

Figure 7:
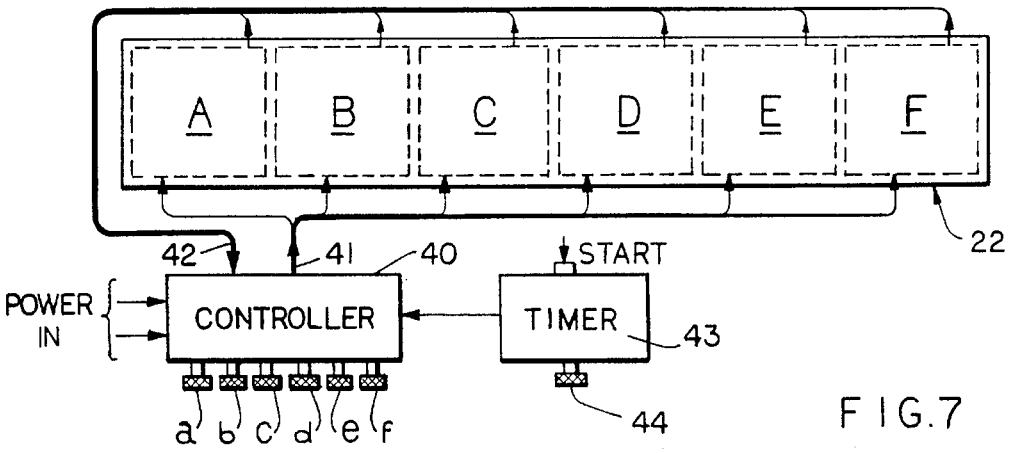
FIG. 7 is a schematic diagram of the heating element of FIG. 1, and control connections serving an array of multiple components of the heating element.

FIG. 7 schematically indicates a preferred layout of the composite heater sheet 22, wherein the described embedded foil (or etched film) 35 is developed independently in each of a plurality of successive zones, here shown as six zones A, B, C, D, E, F. Power supplied to a controller 40 is independently supplied to each of the respective zones via output lines collectively indicated at cable 41 of a flexible harness, and a corresponding number of adjustment elements a, b, c, d, e, f is shown for trimming the supply of electrical energy to the independent heating zones. In addition, another flexible harness configuration, collectively symbolized by a cable 42, supplies temperature-sensed electric signals, independently from each of the heating zones A, B, C, D, E, F, for feedback control of the individual heater-zone supplies, based on individual zone adjustments at a, b, c, d, e, f. It will be understood that the adjustments at a, b, c, d, e, f will be as appropriate for uniformly distributed melting release of wax from sheet 27 and for maximum impregnation of the workpiece running surface 26, 26'. Timing of the wax transfer and impregnation process is governed by suitable adjustment of a timer 43, as at 44, the adjusted time (following START via push button) being optimized by experience, for each of the different kinds of running surface 26, 26' to be treated, from one to the next customer.

It will be seen that the described apparatus and method meet all stated objects and provide for fast, efficient waxing in a single operation and with superior finish. The substrate may be left on the wax-impregnated running surface as a protection during snowboard or the like off-season storage; after storage, a simple "flash" heating is enough to enable the substrate of sheet 27 to be peeled off and any liquid wax at the running surface 26, 26' can be quickly smoothed by squeegee. On the other hand, once the described impregnation treatment has been ended by timer 43, and the heater assembly 20 has been hoisted (via means 11, 12), the substrate of sheet 27 is easily peeled off, and if necessary, surface 26, 26' can be smoothed by squeegee. Using the SKINS sheet material that is mentioned above, the heating apparatus and method of the described invention are able to perform a complete wax-impregnating job on a snowboard in five minutes or less, i.e., in approximately one-third the time of previous methods of hot-waxing a snowboard, namely, in five minutes, as compared to the 15 or 20 minutes previously required. In doing this, it is also important to note that the SKINS sheet contains the correct dosage of wax (i.e., wax content, per unit area) for a single treatment, so that excess wax does not present a problem.

Specific advantages of the invention can be summarized by item, as follows:

A. The heating assembly (or "toaster") 20, is large enough to heat the entire bottom of a snowboard, or ski, or pair of skis, or toboggan, in a single operation which treats the entire area of running surface (26, 26'). For a typical snowboard 24, the dimensions of heating assembly 20 may be 13 inches wide by 73 inches long, thus allowing the heating surface of the flexible composite heating sheet 22 to be 12 inches by 72 inches, i.e., within electrically inert longitudinal-end and lateral-edge margins that are one-half inch wide.

B. The combination of the heating assembly (or "toaster") with a wax-laden sheet 27, such as the commercially available SKINS material enables users to perform better jobs with great savings in time and efficient use of wax.

C. The controller means 40 will be understood to contain a compact circuit board and microprocessor to assure continuous thermostatic monitoring and automatic control of heating in the respective heating zones, for uniformly distributed hot-wax impregnation of the workpiece surface (26, 26').

D. The articulation mechanics of the heating assembly 20 incorporates what may be called one-way hinging action, which allows bending away from a substantially flat upper limit (FIG. 4) when suspended at offset from the workpiece, the bending being downward in gravitational self-adaptation to convex curvature of the workpiece surface 26,26' to be waxed.

E. The heating sheet 22 per se, being a composite with embedded glass fiber reinforcement, is rendered thin and flexible while exhibiting such longitudinal resistance to stretch as to permit relatively great longitudinal spans between strap-supported transverse members 21. For example, for a member-width dimension W=2 inches, 36 members 21 will have articulated interconnection via sheet 22, but an essentially flat upper hinge relation (as in FIGS. 1 and 4) is achieved for the four longitudinal locations of flexible strap suspension, meaning that eight members 21 (between strap-connected members 21) are supported only by reason of the described adjacent sidewall abutments 31 and by reason of the essentially non-stretch property of sheet 22. And for the indicated width of two inches, an overall height H of one inch, and a sidewall height H' of one quarter inch, are suitably proportioned dimensions.

F. For the indicated dimensional relationships of the heating assembly 20, a continuous flexibly articulated passage is defined within the full length of assembly 20; this passage is laterally defined by span S' between the spacer end blocks 32 of each of the transverse members 21, and vertically between the base 30 of the metal channel and the flexible heating sheet 22. A flexible pad 48 of insulating material is visible in FIG. 1 and will be understood to be fully coextensive with the length of assembly 20, thus promoting conservation of heat delivery to the running surface that is being hot-waxed.

Figure 11:
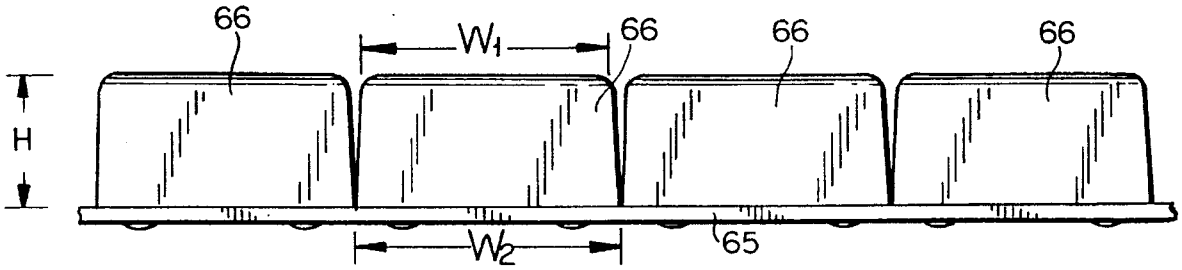
FIG. 11 is a view similar to FIG. 8, for a modification of FIG. 8.

In the embodiments of FIGS. 8 and 11, the invention is shown for the case of a workpiece surface having a camber feature which is characterized by a concave curvature that is shallow (i.e. of large-radius curvature) as compared to the relatively short-radius convex curvature which characterizes one or both longitudinal ends of the workpiece. To enable self-adaptation to such concave curvature, the invention provides several alternative constructions. But first, reference is made to FIG. 8 for discussion of a presently preferred construction for individual transverse members 50 of the overall articulated assembly 20.

Figure 9:
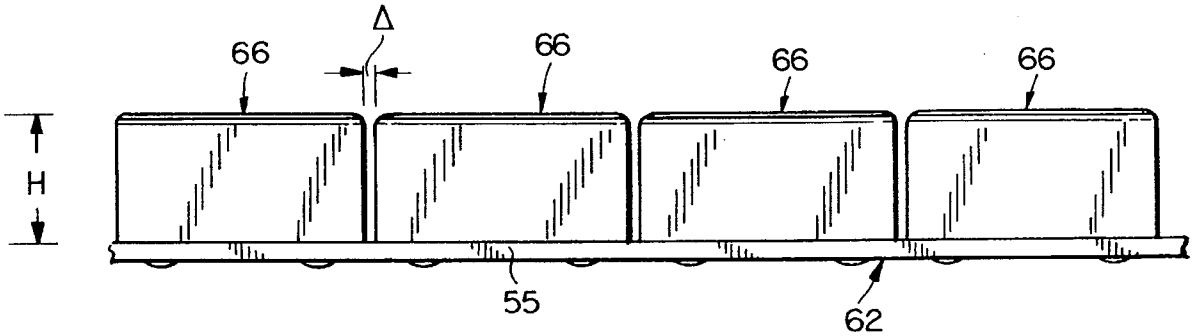
FIG. 9 is a view similar to FIG. 4, for the modification of FIG. 8.
Figure 10:
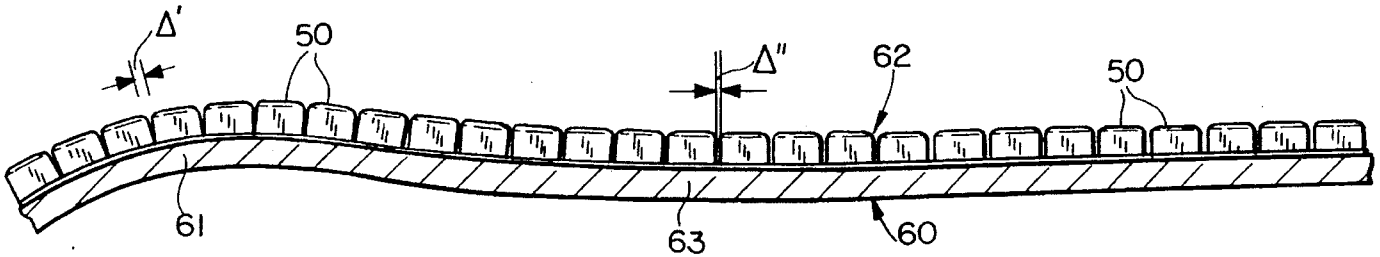
FIG. 10 is a view on a reduced scale for the modification of FIG. 8 but otherwise similar to FIG. 6.

Each of the transverse members 50 is seen in FIG. 8 to comprise an upper panel or surface 51 with short downward side walls 52 which determine the width dimension W, as in the case of the transverse members 21 of FIG. 2. Downwardly bent end flanges 53 terminate in bent mounting flanges 54 which establish the lower surface or horizontal geometric plane of each transverse member 50, at offset H below the upper surface 51. And a flexible heater sheet 55 (as at 22 for FIGS. 1 to 7) will be understood to have electrically inert lateral margins (suggested at 56) whereby sheet 55 may have riveted connection 57 to one or more spaced locations along each of the mounting flanges 54. The downward extent H' of sidewalls 52 will be understood to be short of the offset H, to permit insertion of a flexible pad 48 for containment within the overall articulated assembly 20; and for a cleaner cosmetic appearance, the outer sidewall 52' of the transverse member 50', at each longitudinal end of assembly 20, features an end-closing greater downward extent as seen in the fragmentary detail of FIG. 8A. Also shown in FIG. 8A is an illustrative detail of rivet/washer means 58 for securing a suspension-strap end 59 to the upper-surface panel of member 50:

Additional reference is made to FIGS. 9 and 10 wherein a workpiece 60 has a region 61 of convex curvature to which an articulated assembly 62, as in FIG. 9, is gravitationally self-adapted, while it is also self-adapted to another workpiece region 63 of concave curvature, namely, a camber feature of the running surface of the workpiece. In FIG. 9, the feature of self-adaption to a concave workpiece surface, as at 62, is shown for the described relation of successive adjacent transverse members 50 of rectangular section, wherein, with exaggeration, an incremented longitudinal spacing Δ is built into the relation between successive members 50, when assembled in a horizontal plane to the electrically inert margins of sheet 55. For members 50 of width W, e.g. 2 inches wide, the incremental spacing Δ can be very small indeed, for example, 0.01 inch for the case of a camber concavity of say 1 inch in four feet. As seen in FIG. 10, the self-adaptation to the curves of the workpiece 60, involves articulated widening to a greater space Δ' in adaptation to the convexly curved region 61, and an articulated widening, to a lesser space Δ" (if not edge-to-edge abutment) in adaptation to the concave curvature of the camber region 63 of the workpiece.

In the embodiment of FIG. 11, another articulated assembly 65 of successive transverse members 66 is shown wherein members 66 have a trapezoidal section characterized by an upper-surface width W, which is slightly less than the lower-surface width $W_2$, and their assembly to sheet 65 (on a horizontal plane) is with lower-surface edge-to-edge abutment, leaving the clearance or spacing Δ between confronting sidewalls of adjacent transverse members 66. In applying the assembly 62' of FIG. 11 to a workpiece surface as in FIG. 10, it will be seen that self-adaptation to a convex curvature 61 will involve a widened gap Δ' between adjacent members 66, and a narrowed gap Δ" (if not abutment) between adjacent members 66 in the concave region 63 of camber.

The foregoing discussion of gaps of spacings Δ, Δ', Δ" will be understood to have assumed the relatively non-stretch nature of sheet 62 or 65 in the longitudinal direction. These sheets are of course flexible, and the possibility exists that, with carefully designed longitudinal stretchability of sheet 62 or 65, there may be no need to design edge-to-edge clearances (i.e. gaps Δ) into the articulated assembly, the main point being that only a limited self-adapting accommodation needs to be made for the usual camber concavity, and it is preferred not to design into the articulated assembly any ability to self-adapt to any greater concave curvature that is to be met in use of the present apparatus. Thus, for the described overhead hoist and suspension system, the use of four pairs of straps will be able to lift the assembly 62 (or 65) away from the workpiece, with minimum catenary droop between points of suspension.

I claim:

1. A device for applying wax to the entire surface of a snowboard or ski in a single operation, comprising an elongate mutually articulated plurality of transversely extending members, each of which members is of generally rectangular section defined by an upper surface vertically spaced from a lower surface, and an elongate flexible heating means carried by and secured only to the lower surfaces of said members and providing the only means of articulating connection between adjacent members of said plurality, the weight of said members in relation to the flexibility of said heating means being such that, upon application of the heating means of said device to an upwardly convex elongate work surface, said members will gravitationally self-adapt said flexible heating means to the convex workpiece surface.

2. The device of claim 1, in which said flexible heating means is an embedded component in a flexible sheet of elastomeric material.

3. The device of claim 2, in which said flexible heating means comprises a longitudinal succession of individual heating elements.

4. The device of claim 1, in which an elongate sheet of fiber-reinforced elastomeric material is secured to the lower surface of each of said transversely extending members, whereby to establish articulated interconnection of said members.

5. The device of claim 4, in which said fiber is glass fiber and said elastomeric material is the laminated product of sandwiched consolidation of two sheets of said material with an interposed etched film of electrical-resistance heating material.

6. The device of claim 1, further including a rigid elongate horizontal suspension member with flexible suspension connections to opposite ends of said plurality of transversely extending members.

7. The device of claim 6, wherein said rigid suspension member includes means for selectively vertically raising and lowering said device into and out of gravitationally self-adapted relation to the convex workpiece surface.

8. The device of claim 1, in which each of said members comprises a rigid downwardly open channel defining said upper surface, a downwardly extending end-flange formation at each end of each of said members, and a short laterally directed flange formation extending from the downward end of each end-flange formation, parallel to said upper surface and defining spaced margins of said lower surface, said spaced margins having marginal connection to the respective marginal edges of said heating means.

9. The device of claim 8, in which said laterally directed flanges extend in the direction toward each other.

10. A device for applying wax to the entire surface of a snowboard or ski in a single operation, comprising an elongate mutually articulated plurality of substantially identical transversely extending members, each of which members is of generally rectangular section defined by an upper surface vertically spaced from a lower surface, wherein articulating connection between adjacent members is at or near the lower surface such that in application to an upwardly convex elongate workpiece surface said members will gravitationally self-adapt to the convex workpiece surface, elongate flexible heating means carried by the lower surfaces of said members for application of heat to the workpiece surface and a rigid elongate horizontal suspension member, with flexible suspension connections to opposite ends of said plurality of transversely extending members.

11. The device of claim 10, in which each of said flexible suspension connections is a strap.

12. The device of claim 11, in which each strap connection is detachable.

13. The device of claim 10, in which said flexible suspension connections are additionally to at least one of said transversely extending members, wherein said at least one member is intermediate the end members of said plurality.

14. A device for applying wax to the entire surface of a snowboard or ski in a single operation, comprising an elongate mutually articulated plurality of transversely extending members, wherein said plurality of transversely extending members has an elongate extent that is at least sufficient to lap the entire length of the snowboard or ski and wherein said plurality of transversely extending members has a transverse extent that is at least sufficient to lap the transverse extent of the snowboard or ski, each of said plurality of transversely extending members being of generally rectangular section and having a rigid downwardly open channel, said channel defining an upper surface of each member vertically spaced from a lower surface, wherein articulating connection between adjacent members is at or near the lower surface such that, in application to an inverted snowboard or ski wherein an upwardly exposed snowboard bottom or ski bottom presents an upwardly exposed convex elongate workpiece surface, said members can self-adapt to the convex workpiece surface, and heating means in the form of an elongate flexible strip carried by the lower surfaces of said members for application of heat to the workpiece surface via a sheet of wax-laden material covering the workpiece surface.

15. The device of claim 14, in which said members are in such close adjacency when in flat horizontal array as to flex essentially only in conformance with a convex workpiece surface and as to remain in essentially flat horizontal array when lifted at members that are spaced from each other.

16. The device of claim 14, in which said members are in such close adjacency when in flat horizontal array as to flex with essentially unlimited restraint in conformance with a convex workpiece surface and as to flex with unlimited restraint in conformance with a concave workpiece surface for a predetermined concave camber curvature, with edge-to-edge abutment of the upper surfaces of adjacent transverse members providing said predetermined camber curvature as a limit of self-adaptation to a concave workpiece surface.

17. The device of claim 14, for application to a workpiece surface wherein said convex surface is a first longitudinal-end surface portion and wherein another portion of the same workpiece surface is a concave camber portion, and wherein said members are in such closely spaced adjacency when in flat horizontal array as to flex not only in conformance with the convex portion of the workpiece surface but also in conformance with the concave camber portion of the same workpiece surface.

18. A device for applying wax to the entire surface of a snowboard or ski in a single operation, comprising an elongate mutually articulated plurality of transversely extending members, each of which members is of generally rectangular section defined by an upper surface vertically spaced from a lower surface, wherein articulating connection between adjacent members is at or near the lower surface such that in application to an upwardly convex elongate workpiece surface said members will gravitationally self-adapt to the convex workpiece surface, and elongate flexible heating means supported by the lower surfaces of said members for application of heat to the workpiece surface; each of said transversely extending members comprising a rigid downwardly open channel member defining said upper surface, a vertical spacer block secured within said channel member at each end of the channel member, and said elongate flexible heating means being locally secured at its lateral margins to each spacer block, and each said spacer block being spaced from another between the secured lateral margins of said heating means.

19. The device of claim 18, in which said channel member has side walls of shortened vertical extent, depending downward from said upper surface, the vertical extent of said blocks being greater than the vertically downward extent of said side walls, whereby to define a continuously open longitudinal passage through the articulated succession of said members, and an elongate flexible strip of insulating material contained within said longitudinal passage.

20. A device for applying wax to a workpiece surface wherein the workpiece surface is the entire surface of a snowboard or ski to be waxed in a single operation, said device comprising an elongate mutually articulated plurality of transversely extending members, each of which members is of generally trapezoidal section defined by vertically spaced parallel upper and lower surfaces wherein the lower surface is of greater width, and elongate flexible heating means carried by the lower surfaces of said members for applying heat to the workpiece surface and providing the articulated connection of said members, such that in application to an upwardly convex portion and/or an upwardly concave portion of the workpiece surface, said members will gravitationally self-adapt to the convex and/or concave portions of the workpiece surface, and vertical suspension means for said device including multiple longitudinally spaced flexible connections to members of said plurality.

21. A device according to claim 20, wherein for the condition of said articulated plurality of members gravitationally self-adapted to a flat horizontal surface, the lower surfaces of adjacent transversely extending members are in close edge-to-edge adjacency and the upper surfaces of adjacent transversely extending members are in longitudinally spaced edge-to-edge proximity, whereby to enable the gravitational self-adaptation of said plurality of transversely extending members into conformance with a concave portion of a workpiece surface.

22. A device for applying wax to a workpiece surface wherein the workpiece surface is the entire surface of a snowboard or ski to be waxed in a single operation, said device comprising an elongate mutually articulated plurality of transversely extending members, each of which members is of generally rectangular section defined by an upper surface vertically spaced from a lower surface, and elongate flexible heating means carried by the lower surfaces of said members for applying heat to the workpiece surface and providing the articulated connection of said members, adjacent members of said articulated plurality of members being in such longitudinally spaced edge-to-edge proximity as to enable gravitational self-adaptation of said plurality of transversely extending members into conformance with a concave portion of a workpiece surface.

23. A device for applying wax to a workpiece surface wherein the workpiece surface is the entire surface of a snowboard or ski to be waxed in a single operation, said device comprising an elongate mutually articulated plurality of transversely extending members, each of which members is of generally rectangular section defined by an upper surface vertically spaced from a lower surface, and an elongate flexible sheet of fiber-reinforced elastomeric material secured to the lower surface of each of said transversely extending members, said flexible sheet establishing articulated interconnection of said members, adjacent members of said articulated plurality of members being in such longitudinally spaced edge-to-edge proximity as to enable gravitational self-adaptation of said plurality of transversely extending members into conformance with a concave portion of a workpiece surface, and flexible electrical-heating means along the length of and carried by said elongate flexible sheet.

24. The device of claim 23, in which said flexible heating means is an embedded component of said flexible sheet.

25. The device of claim 24, in which said flexible heating means comprises a longitudinal succession of individual heating elements.

* * * * *